US005335807A

United States Patent [19]

Gregory

[11] Patent Number: 5,335,807

[45] Date of Patent: Aug. 9, 1994

[54] SECURITY LOCK FOR ENCLOSURE

[75] Inventor: Norman S. Gregory, Carlsbad, N. Mex.

[73] Assignee: Scientific Ecology Group, Inc., Oak Ridge, Tenn.

[21] Appl. No.: 36,011

[22] Filed: Mar. 23, 1993

Related U.S. Application Data

[63] Continuation of Ser. No. 843,794, Feb. 27, 1992, abandoned.

[51] Int. Cl.[5] ..... B65D 45/32

[52] U.S. Cl. ..... 220/315; 220/319; 215/274; 292/256.5

[58] Field of Search ..... 220/319, 315, 355, 356, 220/357, 358, 582, 232; 215/354, 364, 274; 292/256.5

[56] References Cited

U.S. PATENT DOCUMENTS

| | | | |
|---|---|---|---|
| 2,952,480 | 9/1960 | Prill et al. | 285/18 |
| 3,165,227 | 1/1965 | Crowell et al. | 220/355 |
| 3,355,056 | 11/1967 | Fisch | 220/42 |
| 3,458,079 | 7/1969 | Gasbarra | 220/24 |
| 3,462,041 | 8/1969 | Wilson | 220/582 X |
| 3,677,430 | 7/1972 | Yates, Jr. | 215/41 |
| 3,986,635 | 10/1976 | Niskin | 202/319 |
| 4,325,914 | 4/1982 | Ruyak | 422/102 |
| 4,496,071 | 1/1985 | Stewart | 220/319 |
| 4,610,266 | 9/1986 | Sandling | 137/315 |
| 5,014,871 | 5/1991 | Mutter | 220/319 X |

*Primary Examiner*—Joseph Man-Fu Moy

[57] ABSTRACT

A container having a bottom, a sidewall attached to the bottom and the sidewall terminates in an open end. A closure member can be removably affixed to close the open end. There is a downwardly extending lip on the closure member that has an inner wall surface opposed to an outer wall surface. One of the inner and outer wall surfaces of the lip slidably adjoins one of the inner and outer wall surfaces of the container wall. A groove is formed in each of the adjoining wall surfaces such that when the closure is mated to the container, the grooves are brought into registry with one another and jointly form a locking passageway within which there is received an elongated locking member of a size to be received within the locking passageway to thereby prevent axial movement between the container and the closure member. The closure member further includes a port that communicates the locking passageway with the exterior of the closure member. The locking member can be inserted into the passageway to attach the closure member to the container.

8 Claims, 1 Drawing Sheet

SECURITY LOCK FOR ENCLOSURE

REFERENCE TO RELATED APPLICATIONS

The instant application is a CONTINUATION of parent application Ser. No. 07/843,794 filed Feb. 27, 1992 for Inventor NORMAN SCOTT GREGORY, entitled "SECURITY LOCK FOR ENCLOSURE", now abandoned.

BACKGROUND OF THE INVENTION

There is a need for a rugged, inexpensive, leak proof, hermetically sealable container that has a long life, that can be locked, and within which radioactive and other dangerous toxic substances can be stored safely. Further, "overpacking" or storage of smaller containers therewithin is desirable. The containers should be easily sealed to render them tamper proof, and preferably are constructed so that they can be stacked in axially aligned relationship to conserve space. The containers and closure members should require very little labor to manually assemble, and they should be resealable to enable reuse thereof.

It would be desirable that such a container be made of plastic to reduce corrosion thereof. The container should be available in various sizes. Apparatus meeting these and other desired criteria is the subject of the present invention.

SUMMARY OF THE INVENTION

This invention comprehends a container having a bottom to which there is attached an upwardly opening sidewall which extends therefrom and terminates in an open end. A closure member by which the open end is closed is removably affixed to and conforms to the open end. A downwardly extending lip on the closure member has inner and outer wall surfaces. One of the inner and outer wail surfaces of the lip slidably adjoins one of the inner and outer wail surfaces of the container wail, and thereby allows the closure member to telescopingly mate with the open end of the container.

More specifically, the apparatus of this invention includes a groove formed in each of the adjoining wail surfaces such that when the closure member is mated to the container the grooves are brought into registry with one another and jointly form a locking passageway. An elongated locking member of a size to be received within the locking passageway is inserted thereinto to thereby prevent axial telescoping movement between the container and the closure member. An external port communicates the locking passageway with the exterior of the closure member and thereby admits the locking member into the passageway.

Still more specifically, the closure member has an inner lip spaced from an outer lip which provides a downwardly opening cavity therebetween. The spaced lips provide the cavity with confronting sidewalls, and the groove is formed within one of the confronting sidewalls, while the co-acting groove is formed in the upper marginal end of the container sidewall adjacent the opening. The port is arranged tangentially respective to the locking passageway. Seal means also are provided by which the container is hermetically sealed. The container and closure member can be made of different types of material, including synthetic plastic and metal, and can be in different shapes and sizes, including round, square, rectangular or oblated. For a square or rectangular shaped container and enclosure, a port can be provided on each side to accept the locking member; or the passageway can extend from diagonally opposed corners.

A primary object of the present invention is the provision of a container having a closure member removably affixed to the open end thereof that can be locked in position and is easily opened and closed without the use of special tools;

Another object of the invention is the provision of a round, oblated, rectangular, square or other shaped container having a complementary shaped closure member that can be removably locked to the open end thereof by a locking member that is inserted into a tangential port on the closure member and thereby prevents axial movement between the container and closure member;

A further object of this invention is to disclose and provide a container and a closure member, with the closure member having spaced lips, a seal on one lip, a locking passageway jointly formed on the other lip and the container outer wall surface, and a locking member removably received in the locking passageway;

A still further object of this invention is to provide a rugged, inexpensive, leak proof hermetically sealed container that has a long life, that can be locked, and within which a smaller container of radio active and other dangerous toxic substances can be stored safely.

These and other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
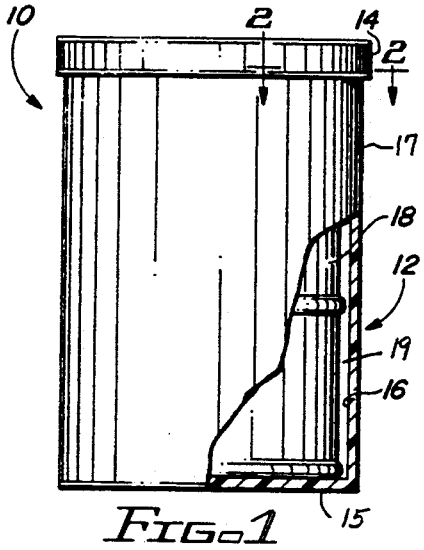
FIG. 1 is a side elevational view of a container and closure member made in accordance with the present invention, with some parts being broken away therefrom, and some of the remaining parts being shown in cross section.
Figure 2:
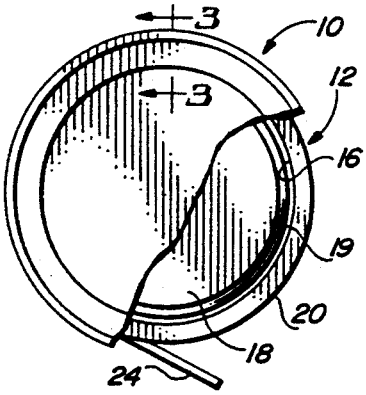
FIG. 2 is a top view taken along line 2—2 of FIG. 1, with some parts being broken away therefrom in order to disclose additional details thereof and to illustrate the opened and closed container.

In the figures of the drawings, and in particular FIGS. 1 and 2, there is disclosed a combination 10, made in accordance with the present invention, and comprised of an improved container 12 and closure member 14 therefor.

The container 12 has a bottom 15, sidewall 17 having inner wall surface 16, and an outer wall surface 20. Numeral 18 indicates the contents of the container 12.

Annulus 19 is formed between inner wall surface 16 of the container and the contents 18.

Figure 3:
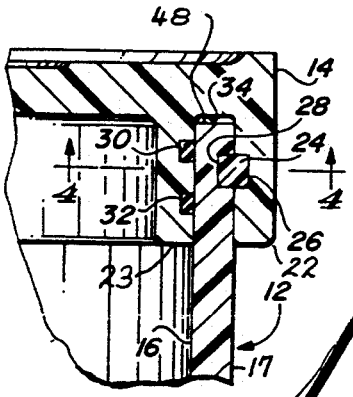
FIG. 3 is an enlarged, fragmentary, cross-sectional view taken along line 3—3 of FIG. 2.
Figure 4:
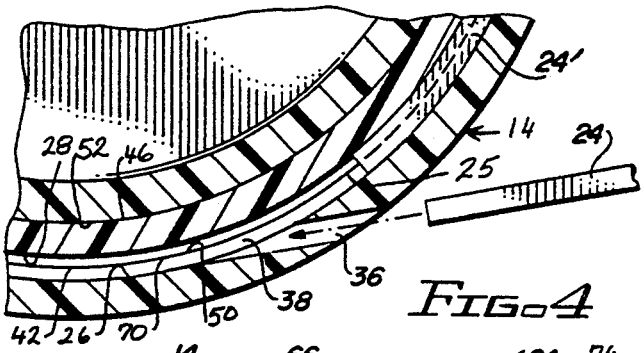
FIG. 4 is an enlarged, detailed view taken along line 4—4 of FIG. 3.

In FIGS. 3 and 4, together with other figures of the drawings, the closure member 14 has downwardly depending, circumferentially extending outer lip 22 and inner lip 23 spaced from one another with the sidewall 17 being telescopingly received therebetween. Numeral 24 indicates an elongated, flexible locking member and numeral 24' shows one end of the locking member in place inside the locking passageway. Numeral 25 is the interface between the closure member 14 and the inner wall surface 16.

A circumferentially extending groove 26 is formed in the inner face of outer lip 22 while a complementary groove 28 is formed on the outer face of container sidewall 17. Inner lip 23 has spaced apart circumferentially extending o-ring grooves 30 and 32 within which there is received o-ring seals. Numeral 34 indicates the blind end of the cavity 48.

In FIG. 4, port 36 is arranged tangentially respective to locking passageway 38. The locking passageway circumferentially extends 360 degrees about the closure member and the upper side wall 17 of container 12, and is jointly formed by the two concentric grooves 26 and 28.

Figure 5:
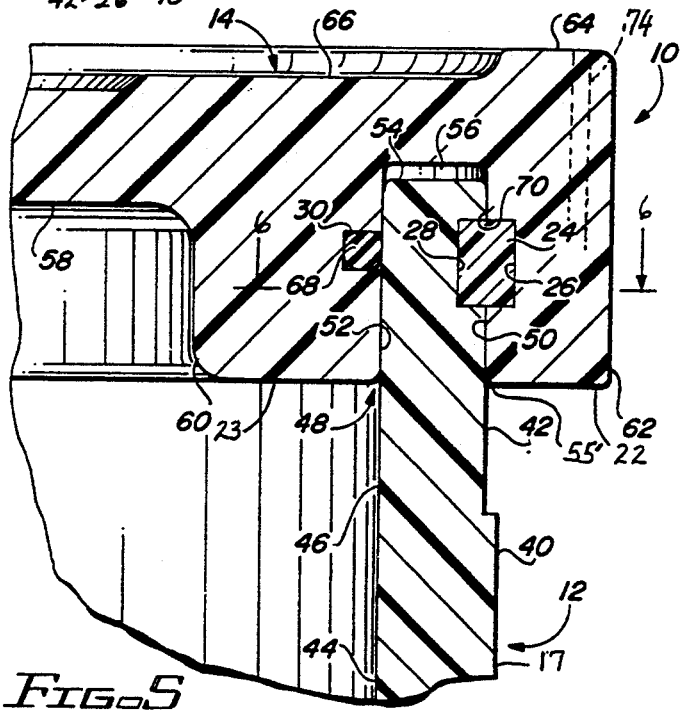
FIG. 5 is an enlarged, detailed, cross-sectional representation of an alternate embodiment also taken along line 3—3 of FIG. 2.
Figure 6:
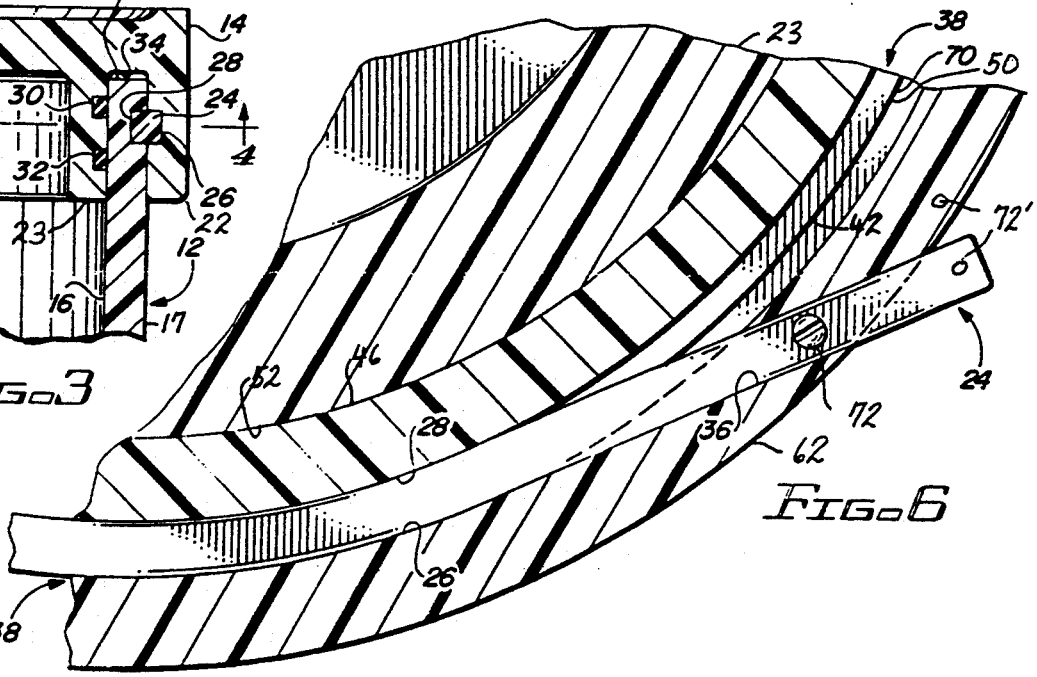
FIG. 6 is a cross-sectional view taken along line 6—6 of FIG. 5.

In the alternate embodiment illustrated in FIGS. 5 and 6, container sidewall 17 is reduced in diameter at opposed sides 42 and 46 and is of a size to be received in close tolerance relationship within the cavity 48. The cavity 48 similarly has confronting machined or formed surfaces 50 and 52 with the before mentioned grooves 26 and 28 being formed within surfaces 50 and 52. Numeral 54 indicates the edge that forms an opening at the top end of container 12. The blind end 34 of cavity 48 and edge 54 preferably abut one another, with there being practically no annular space 56 formed therebetween. The confronting faces 34 and 54 are spaced respective to grooves 26 and 28 whereby abutment of the faces 34 and 54 results in proper alignment of the grooves 26 and 28 whereupon the flexible locking member 24 is easily slidable received therewithin.

A central recess 58 is formed within the closure member 14 for reducing the quantity of plastic material consumed during the manufacturing process. The central recess 58 is formed by wall 60. Numeral 62 indicates the outer circumferentially extending wall of the closure member 14, while numeral 64 indicates the top surface thereof. The top surface 64 is recessed at 66 for receiving the bottom 15 of another identical container 12 therewithin, thereby axially aligning any number of vertically stacked containers 12.

Further, in FIGS. 4, 5 and 6, numeral 68 indicates the o-ring seal. Numeral 70 indicates the interface formed between surfaces 42 and 50 as well as the interface between grooves 26 and 28, and further the centerline of the elongated flexible locking member 24. A fastener 72 is threadedly attached to the bottom of counterbore 74 for securing the locking member 24 within the locking passageway 38 and tangential port 36. Alternatively, the free end of the locking member and the outer edge of the closure member is apertured so that a tamperproof seal means can be attached therethrough to assure that the contents of the enclosure is secure.

The cavity 48 can be a machined surface, or alternatively can be formed by a mold during an injection molding operation. In any event, the cavity walls 50 and 52 together with the walls 42 and 46 must telescope together with close tolerance relation ship to properly compress the O-ring seal 68 so that an optimum seal is effected.

In operation, the container and the closure member are removably affixed to one and another, with the lip extending from the closure member and having an inner wall surface opposed to an outer wall surface, so that one of the inner and outer wall surfaces of the lip slidably adjoins one of the inner and outer wall surfaces of the container wall in a telescoping manner. The locking grooves are formed in each of the adjoining wall surfaces such that when the closure is properly mated to the container, the grooves are brought into alignment and therefore register with one another and jointly form a locking passageway.

An elongated locking member of a size and flexibility to be received within the locking passageway locks the container and closure member together and thereby prevents telescoping movement between the container and the closure member. A port is arranged tangentially respective to the locking passageway and communicates the locking passageway with the exterior of the closure member and thereby admits the locking member to be snaked into the locking passageway where the locking member almost fills the locking chamber. The length of the locking member is selected to cause the inner end thereof to meet a medial part thereof at full insertion of the locking member.

In the preferred form of the invention, the closure member has an inner lip spaced from an outer lip to provide a downwardly opening annular cavity between the two concentric lips. The cavity has confronting sidewalls, with the grooves being formed within the confronting sidewalls presented by a lip and container wall. The edges 55' of the opposed walls 50 and 52 that form the entrance into the annular cavity 48 are chamfered to more easily admit the opposed edges 55 of the end 54 of the container wall 17 thereinto and thereby make allowance for any distortion or deformation therebetween.

This novel feature of the invention, together with the rapid alignment of the grooves 26 and 28 that allows the flexible locking member 24 to be easily slidably received therewithin, reduces the time of exposure of the workmen to radiation.

Other forms of the invention can be used for containers that are circular, oblated, rectangular, square, or other shapes.

I claim:

1. A container having a bottom, a sidewall attached to the bottom and terminating in a substantially cylindrical open end, said sidewall having an inner wall surface parallel and opposed to an outer wall surface;

a closure member removably affixed to and generally conforming to the configuration of the container open end; said closure member having inner and outer concentric lips downwardly extending therefrom, said inner and outer concentric lips having a common central axis, said inner and outer concentric lips having opposed adjacent wall surfaces spaced from and confronting one another to form a downwardly opening cavity therebetween, an inwardly directed locking groove formed within the outermost of said confronting sidewalls of the cavity, an outwardly directed seal groove formed within the innermost of said confronting sidewalls of the cavity;

a marginal open end of the container is made complementary respective to the closure member cavity;

said marginal open end of said container is received in close tolerance relationship within the closure member cavity;

said confronting sidewalls of said cavity are parallel and spaced apart an amount equal to the distance measured between said inner and outer wall surfaces of the container marginal end to thereby slidably adjoin said inner and outer wall surfaces of the container marginal end with the confronting sidewalls of said cavity when the closure member is mated with the container open end;

an outwardly directed, circumferentially extending locking groove formed in the container outer wall surface at a location respective to said locking groove of the outermost of said confronting sidewalls of the cavity such that when the closure member is mated with the container, the locking grooves are brought into registry with one another and jointly cooperate together to form a locking passageway; said locking passageway extends circumferentially about the container and is spaced from the seal groove by the container end when the closure member is mated with the container;

a locking member of a size to be received within the locking passageway and thereby prevent removal of the closure member from the container when said inwardly directed locking groove and said outwardly directed locking groove are brought into alignment with one another; said locking member is a flexible, elongate member that is larger than either of the locking grooves;

port means arranged tangentially respective to the locking passageway and communicating the locking passageway with the exterior of the closure member and thereby admitting the locking member into the locking passageway; and, seal means in said seal groove for sealingly engaging the inner wall surface of the container.

2. The container of claim 1 and further including arranging a second seal groove on said adjoining wall surface of said inner lip; said seal grooves are axially spaced from one another and concentrically aligned with said grooves of said locking passageway; there being a seal means in said second seal groove.

3. The container of claim 2 wherein said inner and outer concentric lips are coextensive downwardly, said confronting sidewalls of said cavity are parallel to one another.

4. In an upwardly opening generally cylindrical container having an upwardly extending sidewall terminating in an open end, and a closure member by which the open end can be closed, the combination of said container and closure member, comprising:

said container sidewall having an inner wall surface opposed to an outer wall surface such that an upper container marginal open end of uniform thickness is provided; said closure member is removably affixed to said marginal open end of said container;

said closure member has a downwardly extending inner lip and a downwardly extending outer lip, said inner and outer lip is an integral part of said closure member, said inner and outer lip jointly form a circumferentially extending downwardly directed cavity on said closure member for telescopingly receiving said upper container marginal open end in close tolerance relationship therewithin, said outer lip has an inner wall surface, said inner lip has an outer wall surface, said outer lip inner wall surface is opposed to and confronts said outer wall surface of said inner lip;

seal means by which said inner lip outer wall surface sealingly engages said container inner wall surface;

said inner wall surface of said outer lip and said outer wall surface of said inner lip, respectively, slidably adjoins said inner and outer wall surfaces, respectively, of said marginal open end of said container when said closure member telescopingly receives said marginal open end of said container therewithin;

there being a groove formed in the wall surface of said container outer wall and a groove formed in the inner wall surface of said outer lip such that when said closure member is mated to the container, said grooves are brought into registry with one another and jointly form a circumferentially extending locking passageway;

a locking member of a size to be received within said locking passageway and thereby prevents telescoping movement between said container and said closure member; and, port means communicating said locking passageway with the exterior of said closure member and thereby admitting said locking member into said locking passageway.

5. The combination of claim 4 wherein said port means is arranged tangentially respective to the locking passageway and communicating the locking passageway with the exterior of the closure member and thereby admitting the locking member into the locking passageway.

6. The container of claim 4 wherein said seal means includes a first and a second seal groove on said adjoining wall surface of said inner lip; said first and second seal grooves are axially spaced from one another and concentrically aligned with said grooves of said locking passageway; there being a seal member in said first and second seal groove;

said inner and outer concentric lips are coextensive downwardly, and said confronting sidewalls of said cavity are parallel to one another.

7. A generally cylindrical container having a sidewall attached to a bottom and terminating in an open upper end, said sidewall having an inner wall surface opposed to an outer wall surface; a closure member removably affixed to and conforming to the container open end; the improvement comprising:

downwardly extending concentric inner and outer lips on said closure member, an inner wall surface on said outer lip opposed to an outer wall surface on said inner lip; said inner and outer wall surfaces of said inner and outer lips confront one another and form a downwardly opening cavity therewithin; the confronting wall surfaces of said inner and outer lips, respectfully, slidably adjoins said inner and outer wall surfaces, respectfully, of said container marginal open end in a telescoping manner;

a groove formed in each of the adjoining wall surfaces between the outer lip and the outer wall of the container such that when the closure member is mated to the container, the grooves are brought into registry with one another and jointly form a locking passageway;

an elongated locking member of a size to be removably received within said locking passageway and thereby lock said closure member to said container and prevent telescoping movement between said container and said closure member;

port means communicating said locking passageway with the exterior of said closure member and thereby admitting said locking member into said locking passageway; said port means is arranged tangentially respective to said locking passageway;

whereby: said locking member can be inserted through said port means into said locking passageway and thereby lock said closure means to said container.

8. The improvement of claim 7 wherein said outer wall surface of the container has an uninterrupted circumference at the open terminal end thereof;

and a seal groove on the outer wall surface of the inner lip; and, a seal means mounted in said seal groove for sealingly engaging the inner wall surface of the container.

* * * * *